United States Patent [19]

Lerner et al.

[11] 4,217,930

[45] Aug. 19, 1980

[54] VENTING PORT FOR SHIPPING CONTAINERS

[76] Inventors: Marc Lerner, Star Route, Swan Lake, N.Y. 12783; Charles Dallas, 1269 N. Pierce Ave., North Bellmore, N.Y. 11710

[21] Appl. No.: 946,704

[22] Filed: Sep. 28, 1978

[51] Int. Cl.[2] ..... F16K 15/18

[52] U.S. Cl. ..... 137/587; 137/517; 220/301; 220/304; 220/366

[58] Field of Search ..... 137/587, 583, 584, 517, 137/526, 384, 559, 589; 220/293, 295, 296, 298, 301, 304, 366

[56] References Cited

U.S. PATENT DOCUMENTS

| | | | |
|---|---|---|---|
| 1,511,610 | 10/1924 | Holmes | 137/559 X |
| 2,452,612 | 11/1948 | Swenberg | 137/526 X |
| 2,757,819 | 8/1956 | Badger, Jr. | 220/295 |
| 3,556,142 | 1/1971 | Sabin et al. | 137/517 X |
| 3,782,411 | 1/1974 | Turner | 137/526 X |
| 4,032,036 | 6/1977 | Sycle, Jr. | 220/301 X |
| 4,140,151 | 2/1979 | Van Becelaere | 137/526 |

*Primary Examiner*—William R. Cline

[57] ABSTRACT

A venting port for refrigerated shipping containers is provided to facilitate the introduction and movement of refrigerated atmospheric air or refrigerant gas through the container. The venting port comprises a pair of flanged rings adapted to engage an opening formed in the wall of the container and to sandwich said wall therebetween, said rings defining a central port extending from the interior to the exterior of the container, a rotatable closure slidably disposed on the inside of the container and movable between a closed position in engagement with one of said flanged rings to seal the port and an open position spaced apart from said flanged rings to permit the entry of ambient air, means attached to the first flanged ring for guiding the closure between the open and closed positions, and locking means comprising a plurality of cooperating radially disposed teeth on one of said flanged rings and the closure to secure the closure in the closed position.

11 Claims, 6 Drawing Figures

VENTING PORT FOR SHIPPING CONTAINERS

BACKGROUND OF THE INVENTION

Insulated shipping containers for food stuffs and other perishable items are usually stored during transit in a refrigerated compartment, such as the hold of a ship, or are provided with means, such as portable refrigeration units or compressed gaseous refrigerant for the introduction to the interior of the container of cooled air or refrigerant gas, to maintain the contents thereof at a desired temperature to avoid spoilage. It is therefore, necessary in the construction of such shipping containers to provide means for the introduction to the interior of the container of refrigerated ambient air or refrigerant gas to facilitate the exchange or movement of cooled air or gas within the interior spaces of the container. This maintains the temperature of the contents at the desired level and avoids the accumulation of stale air and unwanted gasses.

Various means have been provided in the past to accomplish such venting. However, the devices that have been so utilized have been inadequate and unsuitable in many instances. This is due to the fact that they are not adaptable for shipping containers of various sizes and wall thicknesses, are uneconomical to manufacture and install, and fail to provide adequate protection to prevent the pilfering of the shipping containers during transit. Moreover, the venting ports heretofore known have often been formed of material which is not, corrosive resistant and have not been designed to be adequately air-tight to prevent the entry of ambient air at times when such entry was undesirable. In addition, the known means have often been difficult to operate. Furthermore, and most importantly, existing venting ports have been fitted with closure devices that are adapted to be connected to an interior bulkhead of the container. Any movement of such bulkhead relative to the port, which is often experienced, causes an improper seal of the closure and thus unwanted leakage past the port.

There has, therefore, been a long felt need for a venting port adaptable for use on containers of various sizes, that is economical, easy to install and use, and adequately seals the container and vents the container at the desired times.

SUMMARY OF THE INVENTION

In accordance with the present invention, an improved venting port for refrigerated shipping containers is provided which overcomes all of the difficulties found in prior art devices of this type. The venting port of the present invention is connected entirely to an outside wall of the container, is easily openable to facilitate the exchange or movement of ambient air, is of such a design that it will accommodate containers having various wall thicknesses, is weather tight, tamperproof and is readily installed, used and maintainable. In addition, the present invention is more economical to construct and install than those found in the prior art.

In general, the venting port of the present invention constitutes a port and closure device that is adapted to be installed within an opening formed in the wall of a shipping container. The closure device comprises a pair of flanged rings defining a central port, which are adapted to engage the opening in the wall of the container and sandwich said wall therebetween, a rotatable closure slidably disposed on the inside of the container and movable between a closed position in engagement with one of said flanged rings to seal the central port and an open position spaced apart from said flanged rings to define an annular opening to permit the entry of ambient air, means attached to the first flanged ring for guiding the closure between the open and closed positions, and locking means comprising a plurality of cooperating radially disposed teeth extending from one of said flanged rings and the closure to secure the closure in the closed position.

Unlike closure devices found in the prior art, the present invention is adapted to accommodate containers having various wall thicknesses. This is accomplished by means of the flanged rings which comprise cylindrical bodies adapted to telescopingly engage each other and flanged ends extending outwardly at right angles from the cylindrical bodies to contact the inner and outer surfaces of the container wall, respectively. Thus, the thickness of the container wall which the present invention may accommodate depends only upon the degree of overlap with which the telescoping members are provided, which, of course, is merely a matter of design choice. The flanged rings are easy to install, since they can be held in place by fastening means such as rivets or screws which extend through a series of openings formed along the periphery of the flanges and into the body of the wall of the container. Moreover, the opening formed in the container wall does not have to be held to close tolerances as it would in devices where a closure is adapted to seal directly thereagainst, since it is the cylindrical bodies of the flanged rings which actually define the venting port to be opened and closed. Accordingly, the flanged rings can accommodate existing shipping containers having ports or openings formed therein, provided such openings are large enough, or can be enlarged, to receive the cylindrical bodies of the flanged rings, and are not larger than the diameter of the circle formed by the openings in the flanges for the fastening means.

The closure comprises a disc having a concentric step formed therein, or in the alternative a pair of concentric discs secured together, wherein the periphery of one disc is adapted to engage the inside of the cylindrical body of one of the flanged rings and the surface of the other disc is adapted to contact the surface of the flanged ring facing the interior of the container to serve as a stop for the closure. A gasket or O-ring can be disposed between the disc and the flange to seal the port in an air-tight manner, if so desired. The closure also includes a handle which is easily accessible from the exterior of the container.

The guide means are adapted to carry the closure between the open and closed position and to limit the travel of the closure in the open position. Such means preferably comprise a first bracket fixedly disposed on the inside of the container, a plurality of tie rods extending between one of the flanged rings and such bracket to secure the same in a position spaced apart from the flanged ring, and a second bracket rotatably connected to the closure and having a plurality of openings through which the tie rods slidably extend, to guide the closure during sliding movement between in its open and closed positions. The length of the tie rods, of course, determine the size of the annular opening formed by the closure and the flanged rings and can be varied to accommodate a multitude of venting requirements.

As noted hereinabove, cooperating locking means are provided on the closure and one of the flanged rings to secure the closure in the closed position. Such means comprise a plurality of spaced apart teeth extending radially inwardly from the cylindrical portion of one of the flanged rings into the port, and a corresponding plurality of spaced apart teeth extending radially outwardly from the periphery of the smaller diameter portion of the closure adapted to engage and interlock with the inwardly extending teeth. Each series of teeth have an inclined surface to facilitate the interlocking thereof upon rotation of the closure. It will be apparent to those skilled in the art that in order to move the closure to the closed position, the teeth on the closure and the teeth on the flanged ring must be radially positioned so that they may axially pass by each other. The closure may then be rotated to interlock the teeth and thus secure the same in the locked position.

To assist in moving the closure, after rotation to disengage the teeth, a helical compression spring is disposed about each tie rod of the guide means between the inner flanged ring and the second bracket to urge the bracket and the closure connected thereto toward the open position.

The flanged rings and the closure are preferably formed of moldable plastic materials to render their manufacture inexpensive and to maintain an insulating quality between the interior and exterior of the container. However, other corrossion resistant materials, such as fiberglass, or metallic materials, such as aluminum or stainless steel can also be utilized.

The foregoing and additional features of the invention are further described in reference to the annexed drawings.

DETAILED DESCRIPTION OF THE PREFERRED EMBODIMENT

Figure 1:
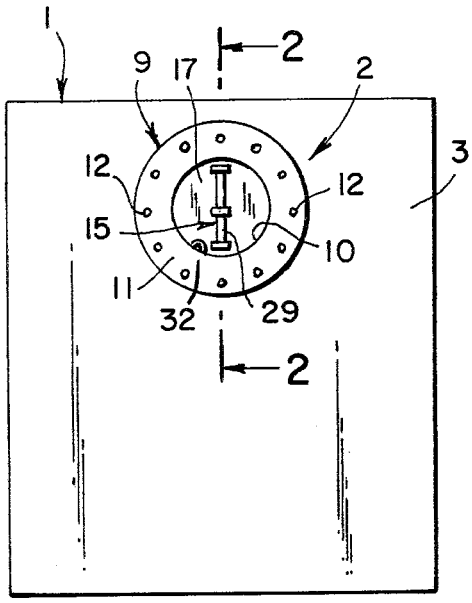
FIG. 1 is a plan view of a shipping container containing a venting port in accordance with the invention.
Figure 4:
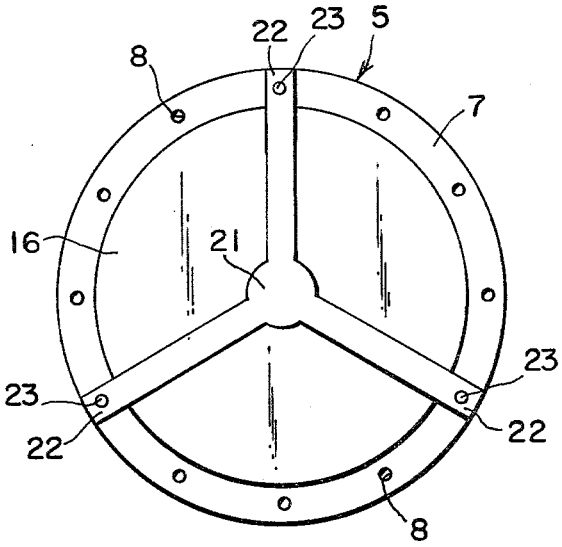
FIG. 4 is a plan view of the venting port of the invention shown from the interior of the container.
Figure 2:
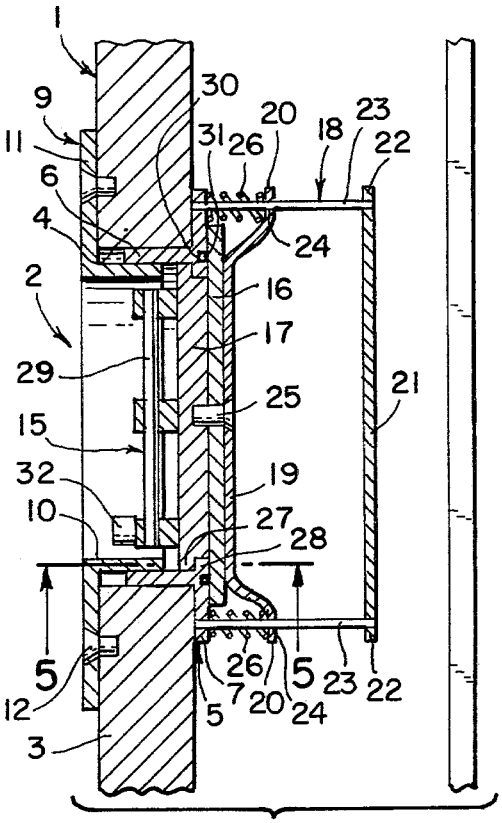
FIG. 2 is a cross-sectional view of the venting port of the invention taken along the lines 2—2 of FIG. 1.

Referring now to the drawings, FIGS. 1 and 2 show a refrigerated shipping container 1 having a venting port 2 in accordance with the invention disposed within and extending through an opening 4 formed in a wall 3 thereof. The venting port 2 comprises a first flanged ring 5 having a cylindrical body portion 6, which extends into opening 4 of the container wall 3 and a flange portion 7 which extends outwardly at right angles from the cylindrical portion 6, and is adapted to contact the inner surface of wall 3. As shown in FIG. 4, the flange 7 of flanged ring 5 has a plurality of small openings 8 formed around the periphery thereof. Suitable fastening means, such as screws or rivets (not shown) extend through openings 8 to secure the ring flange 5 to the inner surface of wall 3. A second flanged ring 9 having a cylindrical body 10 and a flange portion 11 is disposed within the opening 4 of wall 3 on the exterior of container 1 in a manner such that the body 10 telescopingly engages flanged ring 5 and flange 11 contacts the outer surface of wall 3. As shown in FIG. 1 a series of openings 12 are formed along the periphery of flange 11 to receive fastening means to secure such flange to the shipping container. The telescoping engagement of the two flanged rings compensates for varying container wall thicknesses, and assures that the opening in the container wall will be fully lined to prevent air leakage and the entry of contaminants.

Figure 3:
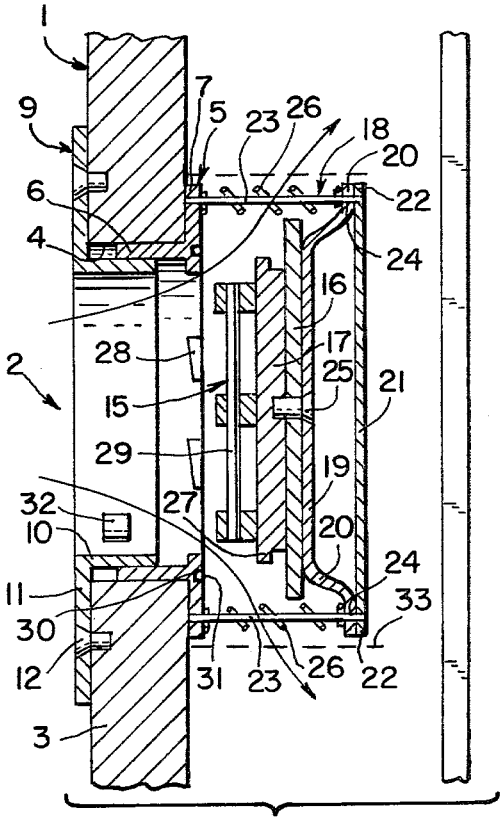
FIG. 3 is another cross-sectional view of the venting port of the invention showing the closure in the open position.

A closure 15 accessible from the exterior of container 1 through the central opening of flanged ring 9 is provided to seal the venting port and permit it to be opened to expose the interior of the container to atmospheric air. The closure comprises a first disc 16 having a diameter larger than the opening in the center of flanged ring 5, and a second disc 17 having a diameter smaller than the interior of cylindrical portion 6 of flanged ring 5, so that such disc may enter therein. The two discs are preferably secured together by bonding or any other suitable means. Alternatively, the two discs can be formed as a unitary structure, and in some instances, depending upon the material of construction, this may be preferable. The closure 15 is movable between a closed position, as shown in FIG. 2, in which the interior of the container 1 is sealed from the exterior atmosphere, and an open position, as shown in FIG. 3, in which the exterior atmosphere is permitted to enter the container for ventilation or other purposes.

Guide means 18 are provided to carry the closure 15 between its open and closed positions. In the preferred embodiment, the guide means comprises a first bracket 19 having three equally spaced radially extending legs 20 shown in FIG. 6 and a second bracket 21 also having three correspondingly positioned equally spaced legs 22. The second bracket 21 is held in a spaced apart juxtaposition with respect to flange 7 of flanged ring 5 by means of three tie rods 23. The tie rods are fixedly connected to both the flange 7 and bracket 21 by means of axially disposed screws or the like, and extend through openings 24 formed in the first bracket 19, so that such bracket is slidably movable together with closure 15 along said tie rods from the closed position, as shown in FIG. 2, to the open position, as shown in FIG. 3. To provide for the smooth movement of bracket 19 along the tie rods 23, the openings 24 formed therein preferably include bushings or sleeves of any suitable design. The bracket 19 is connected to the closure 15 by means of a press fit shaft 25, which permits rotation of the closure with respect to the bracket, which rotation is necessary to effectuate the actuation of the locking device, which will be described hereinafter. Other means for rotatably connecting the bracket 19 to closure 15, such as providing a raised boss on disc 16 which extends through an opening in the center of bracket 19, is also suitable.

To assist in the opening of the closure three (3) helical conically shaped compression springs 26 are disposed about each of the tie rods 23 between flange 7 of flanged ring 5 and legs 20 of bracket 19. Such springs exert a biasing force upon bracket 19 to urge the closure into the open position shown in FIG. 3. To secure the closure in a closed position, locking means in the form of a plurality of cooperating teeth 27 and 28 formed on disc 17 and on flanged ring 5, respectively, are provided. The teeth 27 are equally spaced and extend radially from the outer peripheral surface of disc 17. Similarly, teeth 28 are also equally spaced and extend radially inwardly from the interior of cylindrical section 6 of flanged ring 5. The size and spacing of teeth 27 and 28 are such that the teeth 27 will fit between the spaces created by teeth 28, so that the closure 15 may be moved between the open and closed positions.

Figures 5, 6:
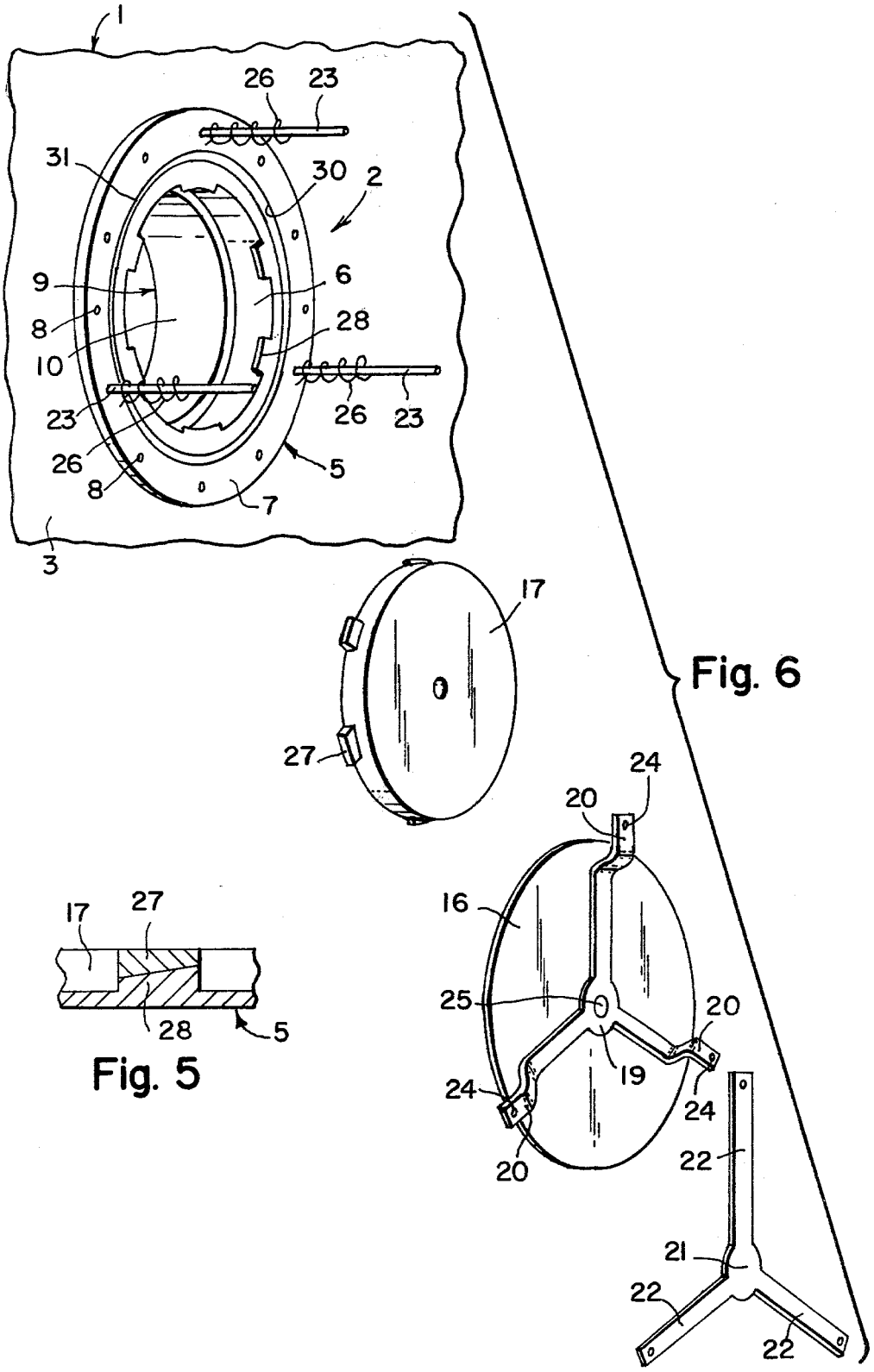
FIG. 5 is a cross-sectional view taken along the line 5—5 of FIG. 2.
FIG. 6 is an exploded isometric view of each of the components which comprise the venting port of the invention.

In the closed position the closure is withdrawn into the central opening of the flanged rings until teeth 27 axially clear teeth 28, at which point the closure 15 may be rotated so that the teeth 27 and the teeth 28 engage each other to secure the closure in the closed position. To facilitate such locking operation teeth 27 and 28 are formed with mating inclined surfaces as shown in FIG. 5.

To allow for the manual operation, a handle 29 accessible from the exterior of container 1 is fixedly connected to closure 15. In the embodiment shown, the handle comprises a shaft extending through suitable ears formed on disc 17. However, it will be apparent to those skilled in the art that handles of other designs could be utilized with equal success.

As an additional feature to assure that the interior of the container will be sealed in an air-tight manner, flange 7 is provided with a groove 30 adapted to receive an O-ring 31. The O-ring as shown in FIG. 2 is compressed by disc 16 when the closure 15 is in the closed position, thus sealing the interior of the container. It will be apparent that a gasket can be utilized instead of the O-ring, if so desired.

To assure that the contents of a given shipping container have not been pilfered or in any way been tampered with, it is customary to seal all access to the interior thereof. In the present invention this is all accomplished by means of a loop 32 formed as an integral part of the cylindrical portion 10 of flanged ring 9. A lock wire or chain with a suitable seal can be connected from loop 32 to the handle 29, thus preventing the handle from being rotated without breaking the seal.

In addition, as another feature of the invention to prevent tampering with the contents of the container, a cylindrical screen 33 shown in FIG. 3 is disposed about the periphery of flange 7 on the interior of the container to enclose the angular opening created when the closure is moved to the open position. Such screen prevents the insertion of a hand or any other article into the container when the closure is in the open position.

The venting port of the invention has been disclosed and described in respect to a specific embodiment. However, variations and modifications thereof within the scope of this invention will be known to those skilled in the art.

What is claimed is:

1. A venting port for a shipping container having an opening formed in a wall thereof comprising, in combination, a pair of flanged rings defining a central port and adapted to extend through the opening in the container wall and sandwich the wall therebetween; a closure rotatably disposed on the inner side of the wall and movable between a closed position in which the closure engages one of said flanged rings to seal the central port and an open position in which the closure is spaced apart from said flanged rings to permit ambient air to enter the container; means for guiding the closure between the open position and closed position; and locking means formed as a plurality of cooperating elements on one of said flanged rings and said closure for securing the closure in the closed position upon rotation thereof.

2. A venting port in accordance with claim 1, in which the flanged rings telescopingly engage each other to compensate for the thickness of the container wall.

3. A venting port in accordance with claim 2, further comprising fastening means to fixedly secure the flanged rings to the container wall.

4. A venting port in accordance with claim 1, further comprising a handle fixedly attached to the closure and accessible through the central port in the flanged rings.

5. A venting port in accordance with claim 1, further comprising means for biasing the port closure toward the open position thereof.

6. A venting port in accordance with claim 1, in which the means for guiding the closure comprises a first bracket fixedly disposed on the inside of the container; a plurality of tie rods extending between the flanged rings and the first bracket to secure said first bracket in a spaced apart juxtaposition with respect to the flanged rings; and a second bracket rotatably connected to the closure and having a plurality of openings through which the tie rods slidably extend to guide the closure during movement between its open and closed positions.

7. A venting port in accordance with claim 1, in which the locking means comprises a plurality of spaced apart teeth extending radially inwardly from one of said flanged rings into the central port; and a corresponding plurality of spaced apart teeth extending radially outwardly from the closure adopted to engage and interlock said inwardly extending teeth.

8. A venting port in accordance with claim 7, in which the inwardly extending teeth each have an inclined surface, and the outwardly extending teeth each have a corresponding inclined surface adapted to mate therewith upon rotation of the closure, to lock the same in its closed position.

9. A venting port for an air-tight shipping container comprising in combination, a first flanged ring adapted to engage an opening formed in a wall of the container from the inside thereof; a second flanged ring adapted to engage said opening from the outside of the container to sandwich the wall therebetween, said rings defining a port extending from the interior to the exterior of the container; a closure rotatably disposed on the inside of the container and movable between a closed position in engagement with the first flanged ring to seal the port, and an open position spaced apart from said first flanged ring to permit the entry of ambient air; means attached to the first flanged ring for guiding the closure between the open and closed positions; and locking means comprising a plurality of cooperating radially disposed teeth extending from the first flanged ring and the closure to secure the closure in the closed position upon rotation thereof.

10. A venting port in accordance with claim 9, in which the guide means comprises a first bracket disposed on the inside of the container; a plurality of tie rods extending between the first flanged ring and the first bracket to secure said first bracket in a position spaced apart from said flanged ring; a second bracket fixedly connected to the closure and having a plurality of openings through which the tie rods slidably extend; and a plurality of helical compression springs each disposed about a tie rod between the first flanged ring and the second bracket to bias the closure toward the open position.

11. A venting port in accordance with claim 10, in which the radial teeth on the first flanged ring and the closure each have cooperating inclined surfaces adapted to mate upon rotation of the closure to secure the same in the locked position.

* * * * *